US005893260A

United States Patent [19]

McKenna

[11] Patent Number: 5,893,260

[45] Date of Patent: Apr. 13, 1999

[54] PORTABLE APPARATUS FOR FORMING AND FILLING SANDBAGS

[76] Inventor: Mark McKenna, 36304 E. Cr., 1400N, Mason City, Ill. 62664

[21] Appl. No.: 08/937,012

[22] Filed: Sep. 24, 1997

[51] Int. Cl.[6] ..... B65B 09/20

[52] U.S. Cl. ..... 53/451; 53/551; 53/553

[58] Field of Search ..... 53/551, 553, 451, 53/467, 391; 405/128, 129; 460/22, 904; 56/327.1; 37/304, 305, 142.5, 403; 171/11, 43, 113, 135, 144, DIG. 1

[56] References Cited

U.S. PATENT DOCUMENTS

| | | | |
|---|---|---|---|
| 687,312 | 11/1901 | Hughes | 171/11 |
| 706,981 | 8/1902 | Massey | 171/11 |
| 1,481,211 | 1/1924 | Keech et al. . | |
| 1,546,360 | 7/1925 | Bates | 53/451 |
| 1,588,649 | 6/1926 | Bates | 53/451 |
| 1,644,098 | 10/1927 | Warren | 37/304 |
| 1,763,810 | 6/1930 | Newman et al. . | |
| 1,814,094 | 7/1931 | Rhodes . | |
| 2,160,367 | 5/1939 | Maxfield | 53/551 |
| 2,667,021 | 1/1954 | Johnson | 171/11 |
| 2,711,742 | 6/1955 | Lavers | 171/11 |
| 2,777,219 | 1/1957 | Brant | 37/86 |
| 3,597,909 | 8/1971 | Lauridsen | 171/11 |
| 3,602,402 | 8/1971 | Garden | 222/196 |
| 3,791,052 | 2/1974 | Van Der Lely | 37/8 |
| 4,044,921 | 8/1977 | Caverly | 222/74 |
| 4,184,522 | 1/1980 | Waite | 141/231 |
| 4,407,108 | 10/1983 | Craig | 53/451 |
| 4,599,850 | 7/1986 | Kopp | 53/451 |
| 4,607,703 | 8/1986 | Wang | 171/1 |
| 4,869,048 | 9/1989 | Boeckmann | 53/451 |
| 4,947,621 | 8/1990 | Christine | 53/451 |
| 5,014,493 | 5/1991 | West | 53/410 |
| 5,121,775 | 6/1992 | McClain | 141/83 |
| 5,215,127 | 6/1993 | Bergeron | 141/10 |
| 5,242,246 | 9/1993 | Manchak | 405/128 |
| 5,491,960 | 2/1996 | Taylor | 53/568 |
| 5,664,402 | 9/1997 | Sandvik | 53/384.1 |
| 5,669,732 | 9/1997 | Truitt | 405/20 |
| 5,771,665 | 6/1998 | Nelson | 53/459 |

*Primary Examiner*—Daniel B. Moon
*Assistant Examiner*—James P. Calve
*Attorney, Agent, or Firm*—Knechtel, Demeur & Samlan

[57] ABSTRACT

A method and apparatus for automatically forming and filling sandbags. The apparatus has an excavator for obtaining fill material for the sandbags. The fill is transported from the excavating means to a hopper which dispenses the proper amount of fill into a bag. The bag is formed from two webs of bag forming material which are joined along their edges to form a tube. A clamping, cutting and stitching mechanism clamps and cuts the tube, forming the tops and bottoms of the sandbags. A stitching mechanism stitches the cut top and bottom. The clamping, cutting and stitching mechanism is operated by a hydraulic piston which pulls the sandbag web material from rolls and moves the web from the filling area to the discharge area. A conveyor system moves the formed sandbags from the device for stacking or use. The entire apparatus is mounted on a tractor-type frame so that it can be transported from one location to another.

35 Claims, 14 Drawing Sheets

PORTABLE APPARATUS FOR FORMING AND FILLING SANDBAGS

I. FIELD OF THE INVENTION

This invention relates to a portable apparatus which automatically forms and fills a sandbag with sand or other material with a minimum of human intervention.

II. DESCRIPTION OF THE PRIOR ART

Sandbags have been used for thousands of years. Surprisingly though, virtually no form of complete automation has been introduced into the field. Of the millions of sandbags used yearly, most are filled by hand. There is absolutely no reason, be it financial or technical, that such a labor-intensive method of accomplishing such a necessary job should remain unchanged to the present time. With hundreds of millions of sandbags needed yearly worldwide, and almost every one being a product of hand labor, there is ample room for streamlining the process of acquiring the fill, producing the bags, filling them, closing them, and finally, stacking them for shipping.

Several pieces of apparatus exist which aid in the filling of sandbags, but there is no piece of machinery which automates the entire process, from the production of the bags, to the problem of transporting and storing them.

The amount of money spent on sandbag production is very large, due to the sheer amount of manual labor involved. The components of individual sandbags are inexpensive to produce. The sandbags are filled using heavy, manual labor, usually performed for low wages, but due to the large number of sandbags needed in even a small flood makes cheap, manual labor costs become expensive.

Sandbagging is used in flood control, temporary construction and military applications. It remains the most cost-effective and efficient method of flood control and military construction to date. Millions of sandbags are used for flood control when river banks overflow. In military installations, such as those encountered in Vietnam, up to thirty million sandbags a month were utilized. All of these were filled by hand. The small size of the sandbag (seventeen by ten by four inches), makes its carrying and positioning a one man operation. When sandbags are used as a single unit of many, the size allows great flexibility for building earth works. The use of sandbags is comparable to that of brick. It can be used in a variety of positions and numbers to create unlimited and differing results. Once the sandbags are set, they can be easily removed and repositioned as required.

Until the 1960's, the bags were made of burlap, folded, and sewn on two sides, with a drawstring in the third side. By the 1970's, a woven polypropylene replaced the burlap, and technical innovation in bags came to a halt.

Currently, bags are woven, folded, and sewn at a remote facility, after which they are shipped to the site and filled. In most instances, the sandbags are filled strictly through manual labor. A person fills them with a few shovels full of soil or sand, pulls and ties the drawstring, and tosses the completed bag into a pile to be picked up at a later time. If the process of filling the bags were to be automated, labor would be freed for the positioning of the sandbags.

There have been some attempts made to partially automate the sandbag filling operation. For instance, in U.S. Pat. No. 3,602,402 to Garden, there is illustrated a sandbagging machine which fits over the tailgate of a dump truck bed. The sandbags are pre-made and hook on to the bottom of the device. As the bed of the truck is raised, the filling material loads into the device's hopper. From the hopper, the filling material flows into the filling chutes. The sandbags are manually filled when the chute overlying a particular sandbag is open. This patent has several drawbacks. First, it does not provide a method to extract or excavate the fill necessary for the sandbags. The fill must first be brought in and placed into the apparatus. Second, the bags must be pre-made and be able to fit under the respective filling chutes. The bags are then manually drawn from the hopper and tied.

U.S. Pat. No. 4,044,921 issued to Caverly, there is a sandbag filling apparatus which has a hopper with rotatable members which fluff the sand in the hopper. A conveyor belt receives sand from the hopper, moves it to a conveyor discharge, and directs it into a bag chute. The sandbags are attached under the chute to receive the sand until the bag is filled. As also seen in the '402 patent, the bags must still be preformed, manually placed in position, tied, and removed.

U.S. Pat. No. 5,121,775 to McClain discloses and claims a portable apparatus for filling sandbags. This device illustrates a portable unit consisting of a hopper which receives the raw fill. The fill is then dropped on to a conveyor belt which deposits the material into a bagging head which has two outlet ports. The fill falls into sandbags placed underneath the outlet ports. However, the bags must be manually removed and tied. Therefore, only one part of the complete sandbag making and filling operation is accomplished automatically.

III. SUMMARY OF THE INVENTION

The present invention presents a method and apparatus for continuously making and filling sandbags. A trencher or excavator excavates sand or dirt from a source, such as the ground or a sand pile, and transports the sandbag filling material to a hopper. The filling material is dumped into a hopper, and a screw conveyer meters out a predetermined amount of filling material upon demand. The material from which the sandbags are made is stored on two continuous webs, each web being mounted on a roller. As the webs are drawn past the discharge end of the screw conveyor by means of hydraulic cylinders, the edges of the two webs of material are pressed together along the outer edges and sealed, forming the sides of the sandbag. A control mechanism activates the screw conveyor to discharge a predetermined amount of filling material. Jaws at the end of the hydraulic cylinders grasp the web and pull it downward. By the time that the proper amount of fill is metered out from the screw conveyor, the hydraulic cylinders are at the bottom of their stroke. A cutter is activated, thereby cutting the web. A folding and stitching mechanism folds over the cut portion and stitches it, forming the bottom of the sandbag. Simultaneously, the top of the previously formed sandbag is also folded and stitched, thereby sealing the top of the previously filled bag.

The jaws are opened and the hydraulic cylinders retract, pulling the jaws back up toward the screw conveyor. They will once again clamp down on the partially formed bag and repeat the cycle. In this manner, the bags are automatically formed and filled with a predetermined amount of filling material. After the bags are formed, stitched, and cut, they are automatically discharged and fall into a pile where they then can be manually or automatically removed. The system will continue to operate as long as there are filling and bag forming materials present. Furthermore, the entire system mounts on a portable frame which has a wheeled drive system. This allows the excavator to move through a fresh supply of filling material. As a result, when the operation is finished at one location, the entire system can move to another location where sandbags are needed.

VI. OBJECTS OF THE INVENTION

Accordingly, it is an object of the present invention to provide an automated sandbag filling apparatus which is easily transported from one location to another. Another object of the invention is to provide a sandbag filling apparatus which automatically forms bags from webs of bag forming material. A related object is the object of providing sandbags made of a particularly suited material to meet the requirements of a given application.

Yet another object of the invention is to provide a sandbag filling apparatus which automatically excavates, forms, fills, and discharges sandbags at one central location. An advantage of this system is that it minimizes the use of manual labor for filling, sealing, and transporting the sandbags.

Still another object is to provide sandbags which are sealed along the edges by either adhesive or stitching means, wherein the ends of the bags are cut from a continuous web of material that is folded and stitched, thereby providing secure, closed ends of the sandbag.

Other objects and advantages will become apparent to those skilled in the art upon reviewing the following detailed description of the preferred embodiment, and in light of the accompanying drawings and appended claims.

V. BRIEF DESCRIPTION OF THE DRAWINGS

VI. DESCRIPTION OF THE PREFERRED EMBODIMENT

Figure 1:
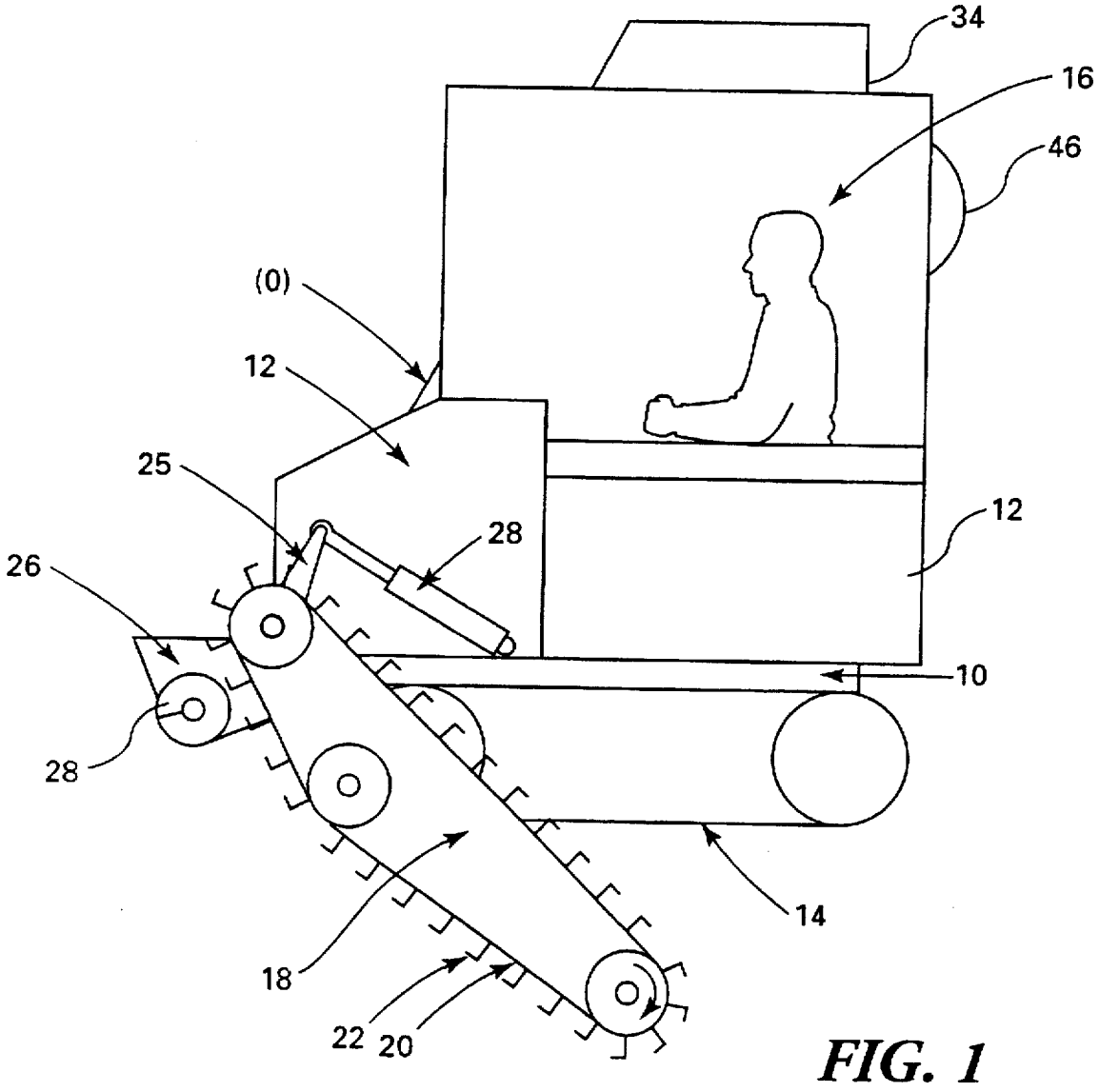
FIG. 1 is a left side elevation view of the mobile sandbag forming and filling apparatus.
Figure 2:
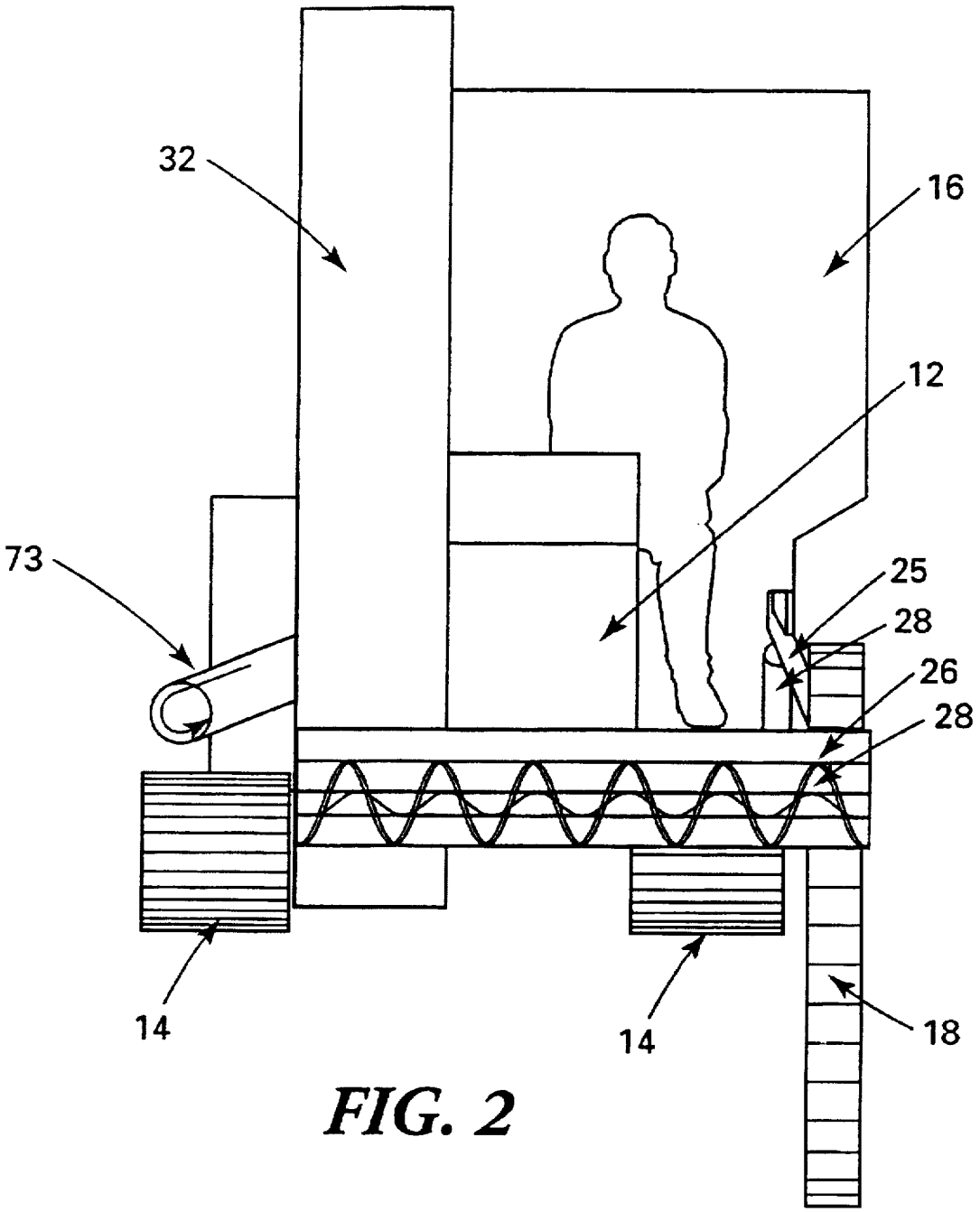
FIG. 2 is a front elevation view of the apparatus of FIG. 1.

Referring to the drawings, and particularly to FIG. 1, the automated, portable sandbag making and filling apparatus 10 is illustrated. The apparatus 10 mounts on a tractor transport frame 12 which is moveable by means of crawler tracks 14. Alternatively, the device may substitute tires for the crawler tracks. The utilization of tires advantageously allows the vehicle to be transported more quickly, but may not provide traction necessary in extreme wet, muddy, or sloping land areas. In an alternate embodiment, the apparatus 10 may be mounted on a trailer connected to a standard agricultural tractor. An operator's cabin 16 includes the controls for the overall control of the tractor transport 12 and much of the equipment mounted thereon.

At the front of the apparatus 10 is a trencher or excavator 18. It is of standard design, having a drive chain 20 with teeth and/or buckets 22 mounted on it. As the drive chain 20 is driven, the teeth and buckets 22 will lift the sand, gravel, dirt or other fill 24 from the ground to the top of the excavator 18. A boom 25 controls the angle and depth of the trencher or excavator 18 with respect to the ground. The boom 25 is controlled by a hydraulic ram 28 which, in turn, adjusts the angle and depth of the trencher. The preferred excavator 18 is a toothed rubber conveyor because it exhibits excellent flow characteristics in any material 24 from flour-like dust to viscous mud, and can convey them at an angle approaching vertical.

It is necessary to position the cabin 16 as near to the trencher 18 as possible. The reason is that the trencher 18 is a potentially dangerous piece of machinery and must be monitored very closely during operation. Not only is it potentially dangerous to humans, but the operator must be aware of what the trencher 18 is digging into. It must not be allowed to contact large stones, tree trunks, etc. It is also imperative for the operator to see both the condition of the fill 24 and the rate at which it is taken up. By adjusting the relative rates of trenching speed to ground speed, he can maintain a constant level of fill intake, regardless of conditions.

Figure 3:
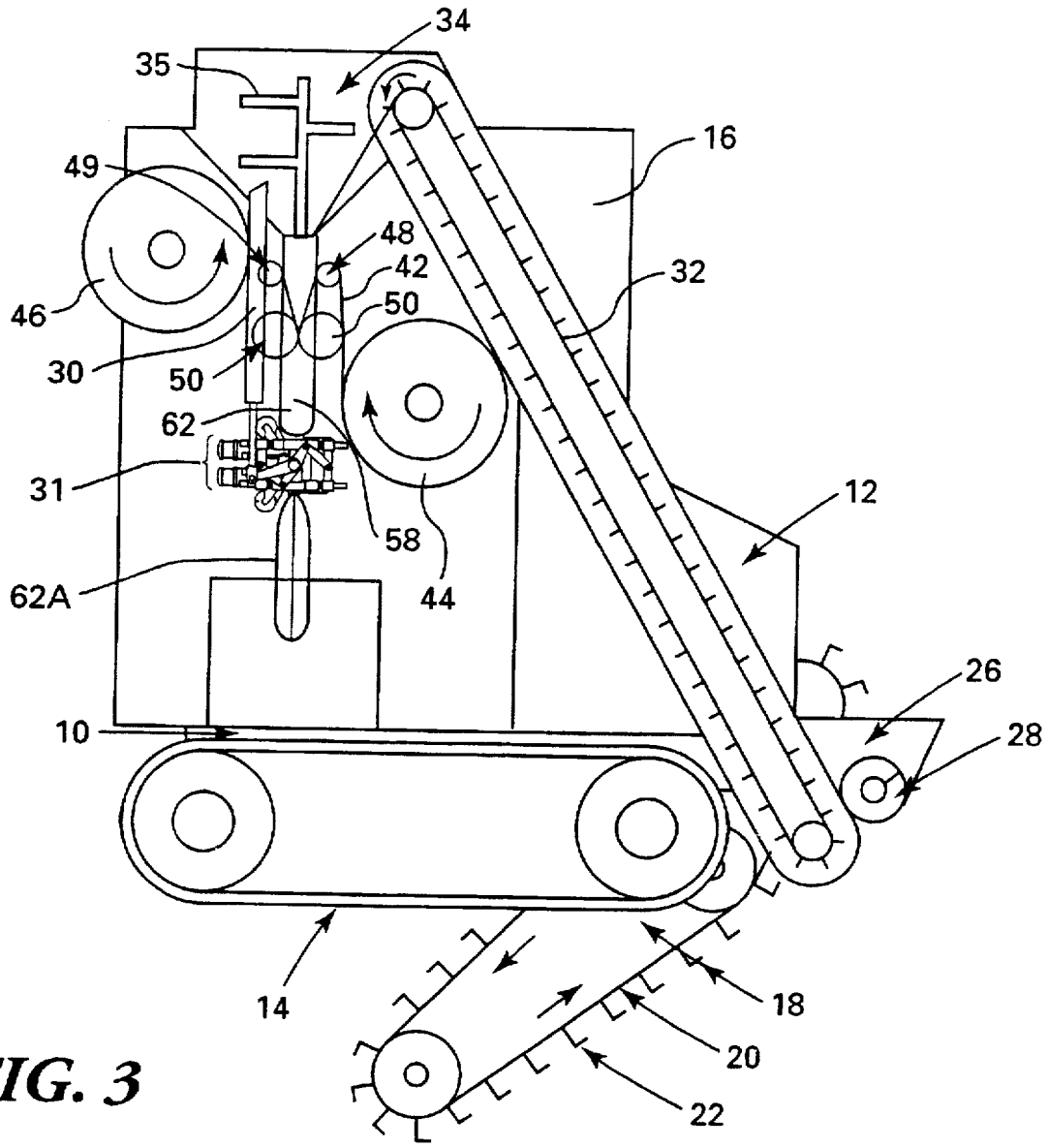
FIG. 3 is a right side elevation view of the apparatus of FIG. 1.
Figure 4:
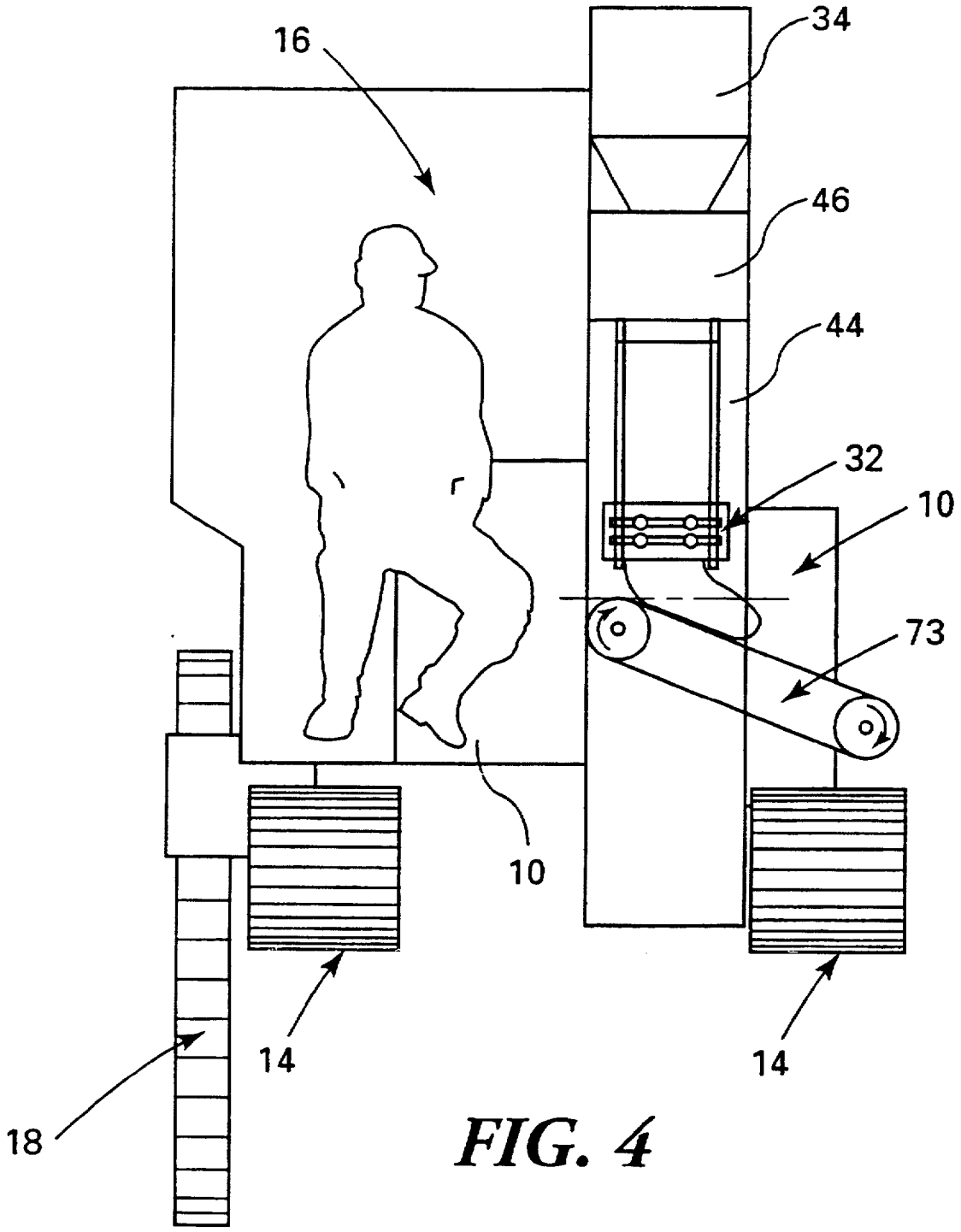
FIG. 4 is a rear elevation view of the apparatus of FIG. 1.
Figure 5:
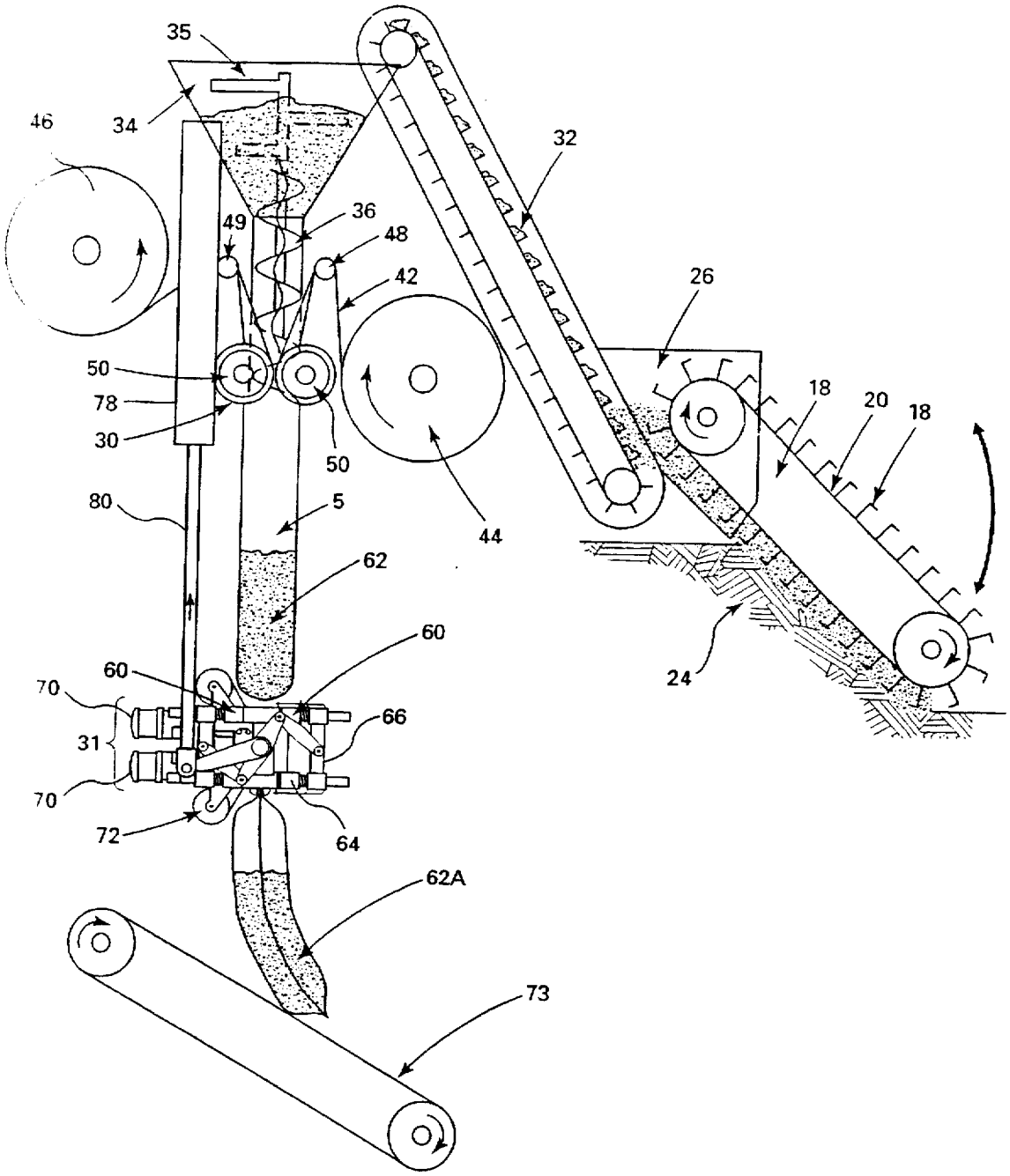
FIG. 5 is a schematic side elevation view of the inventive apparatus with the transport frame and wheels removed, showing the flow of excavated material through the apparatus and into the formed sandbags.

Also as seen in FIGS. 3 and 5, a bag forming mechanism 30 forms the outside of the sandbag from rolls of bag forming material. Below the bag forming mechanism 30 is a clamping, cutting, and stitching mechanism 31 which holds the ends of the formed bag, cuts the individual bags from the web of material, and folds the ends over and stitches them.

The flow of fill 24 can be most clearly illustrated from viewing FIGS. 1–4. The fill 24 is excavated from the earth or sand pile by the teeth 22 of the excavator 18, is lifted and dropped into a lateral hopper or trough 26. Within hopper 26 is a screw conveyor 28. The hopper 26 and screw conveyor 28 extend laterally across the entire front of the apparatus 10 to move the fill 24 from the left side of the apparatus 10 to the right side. This can be seen in FIG. 2.

Turning to FIGS. 3 and 5 which show the right side elevation of the apparatus 10, there is a conveyor 32 that receives the fill 24 from the screw conveyor 28 and raises it to a hopper 34. Baffles 35 rotate in the hopper 34 to keep the fill 24 loose and to prevent it from sticking together in clumps. A twin screw conveyor 36 has a pair of screw feeders 38 controlling the flow of fill 24 through the screw conveyor 36 to a discharge end 40.

A control system (not illustrated) monitors and meters out a predetermined amount of fill 24 from the discharge end 40 by controlling the number of revolutions of the screws within the twin screw feeder 38. Each revolution of the screws dispenses a predetermined amount of fill 24. The operator should be positioned in the cabin 16 so that he can see the sandbags as they are filled. The metering system has to be adjusted for each soil type and condition in which the apparatus 10 is working. The sandbags cannot simply be weighed, as equal weight portions of wet and dry sand have different volumes. Nor can there be simply a predetermined number of revolutions the screws make during the filling cycle, as a wet highly viscous soil has different flow characteristics than a dry powdery one. Thus, the simplest solution is for the operator to analyze the soil characteristics, and adjust the filling accordingly. This can be accomplished by a dial inside the cabin 16 which controls the number of revolutions the screw makes during a filling cycle. By visual observation, the operator can adjust the amount of fill 24 discharged into a bag.

Figure 6:
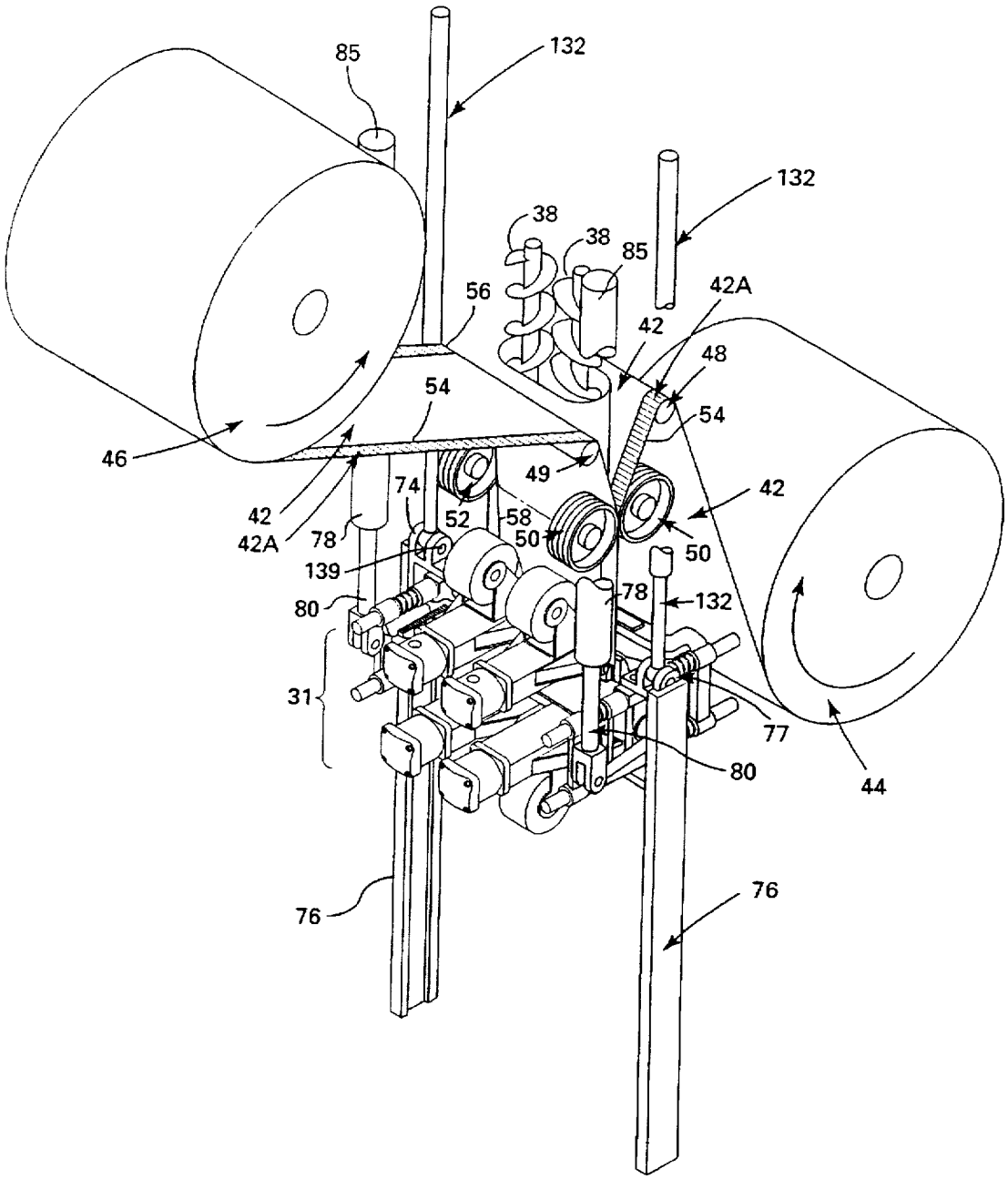
FIG. 6 is an enlarged perspective view with portions of the filling material conveyor means removed, showing the formation of the sandbag from a continuous web of bag material.

As seen in FIGS. 3 and 6, the sandbags are formed by the sandbag filling apparatus 10 at the point of fill material introduction. A bag forming material, preferably continuous webs of woven polypropylene 42, 43 are stored on two rolls 44, 46. The web of material 42 is drawn from roller 44 around an idler roller 48 and has one edge compressed between a nip formed by a pair of edge sealing rollers 50, and the other edge compressed between a nip formed by another pair of edge sealing rollers 52. The other web of material 43 is drawn from the other storage roller 46, passes around an idler roller 49 and has complementary edges compressed between the nip formed by the edge sealing rollers 50 and 52. An adhesive is applied to edges 54, 56 of the web of material 42, 43 between the two confronting webs, which, when pressed between the edge sealing rollers 50 and 52 causes the edges of the web to seal. The adhesive can either be preapplied to the edges (for example, by utilizing a pressure sensitive type adhesive), or applied at the point of web confrontation. Alternatively, a stitching mechanism can be used in place of adhesive. The sealing together of the two edges of the webs causes a tube 58 to be formed. The tube 58 at this point is continuous and has open ends.

As seen in FIG. 5, the lowermost end of the tube 58 is clamped between holding jaws 60 which clamp the opposite webs 42, 43 of material together. This effectively closes the bottom of the tube. The fill 24 exits from the discharge end 40 of the screw conveyor 36 into the tube 58 and causes the bag to fill and expand adjacent to the upper holding jaws 60. As the fill 24 is gravity fed into the tube 58, it will tend to slightly expand and bulge out adjacent to the upper holding jaws 60. A filled bag 62 is thus formed. The top of the tube 58, near the discharge end 40, will tend to remain narrow toward its neck. The clamping, cutting and stitching mechanism 31 then begins the next operation.

The clamping, cutting and stitching mechanism 31 performs three separate functions. As previously stated, the upper holding jaws 60 pinches and seals the bottom of the formed tube 58. This retains the fill 24 within the tube. Lower holding jaws 64 pinch and seal the top of a previously formed bag 62*a*. A cutting blade 66 cuts the tube 58 between the upper holding jaws 60 and lower holding jaws 64. A folding mechanism 68 simultaneously folds the formed bottom flap of the bottom of the tube 58 in an upward direction so that the bottom flap will fold back under itself. The folding mechanism also folds the top of the previously formed bag 62*a* back over itself. A stitching mechanism 70 draws wire or other suitable fastening threadlike material from a plurality of spools 72 and stitches the bottom flap of the filled bag 62 so that the bottom is sealed. Likewise, the top of the previously filled and formed bag 62*a* is stitched closed. The jaws 60 and 64 open, thereby releasing the bag 62*a* which drops onto a conveyor 73 to be moved to a stacking or use area.

As an alternative to utilizing two rolls of continuous web bag forming material, a single web, which has a width equal to the width of the two combined rolls, may be used. The single web is drawn from a storage roller as previously described. However, the single web is formed and folded into a hollow tube. The edges of the web are sealed either by use of glue or by stitching material. The tube is then filled with the filling material, cut, and stitched as described in the prior embodiment. An advantage of using a single web is the elimination of one of the edge sealing steps required when joining two webs together. This decreases the complexity of the apparatus 10 and forms a stronger sandbag.

Figure 7:
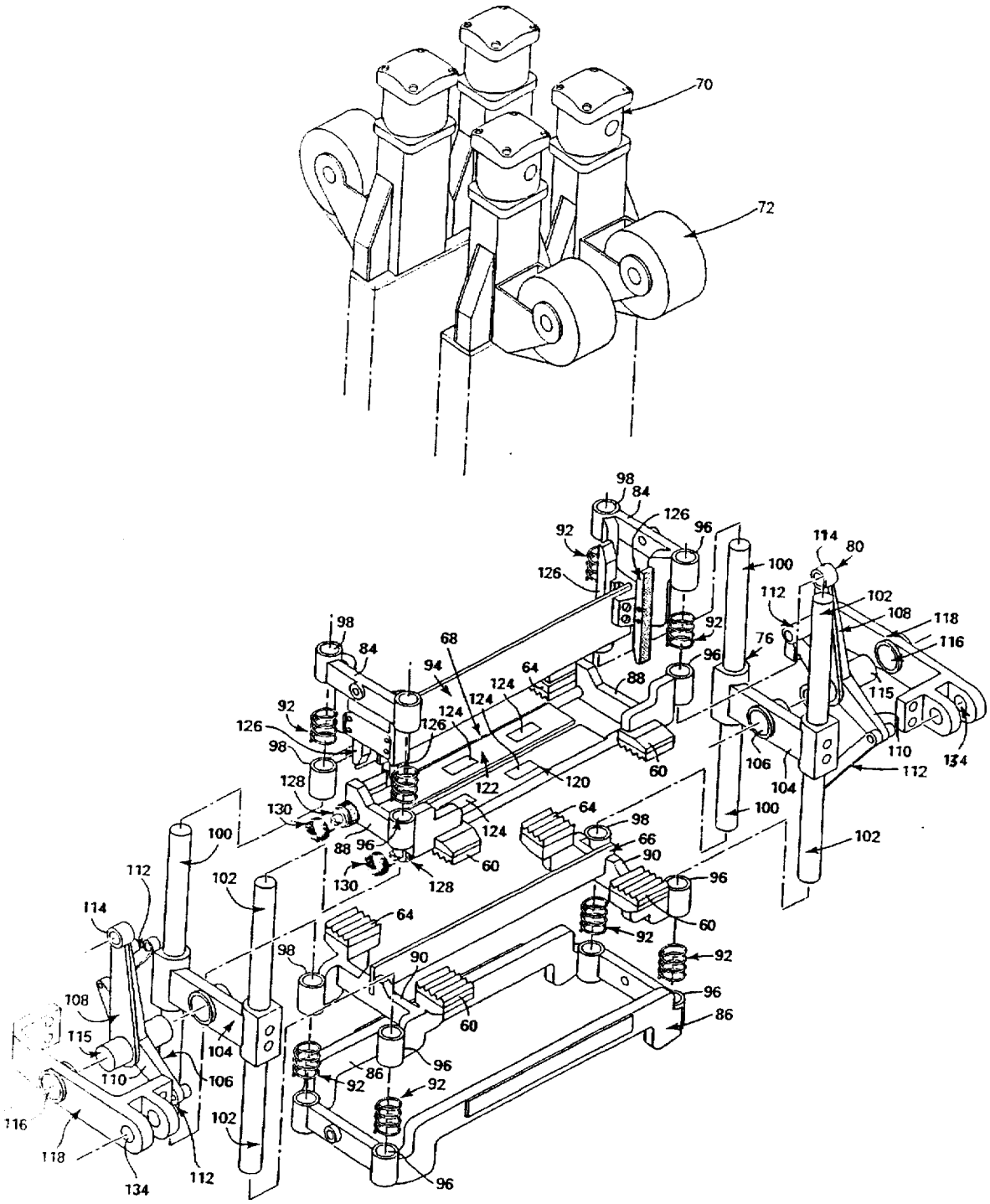
FIG. 7 is an enlarged exploded view of the clamping, cutting, and stitching mechanism rotated 90° from its normal operating position.
Figure 8:
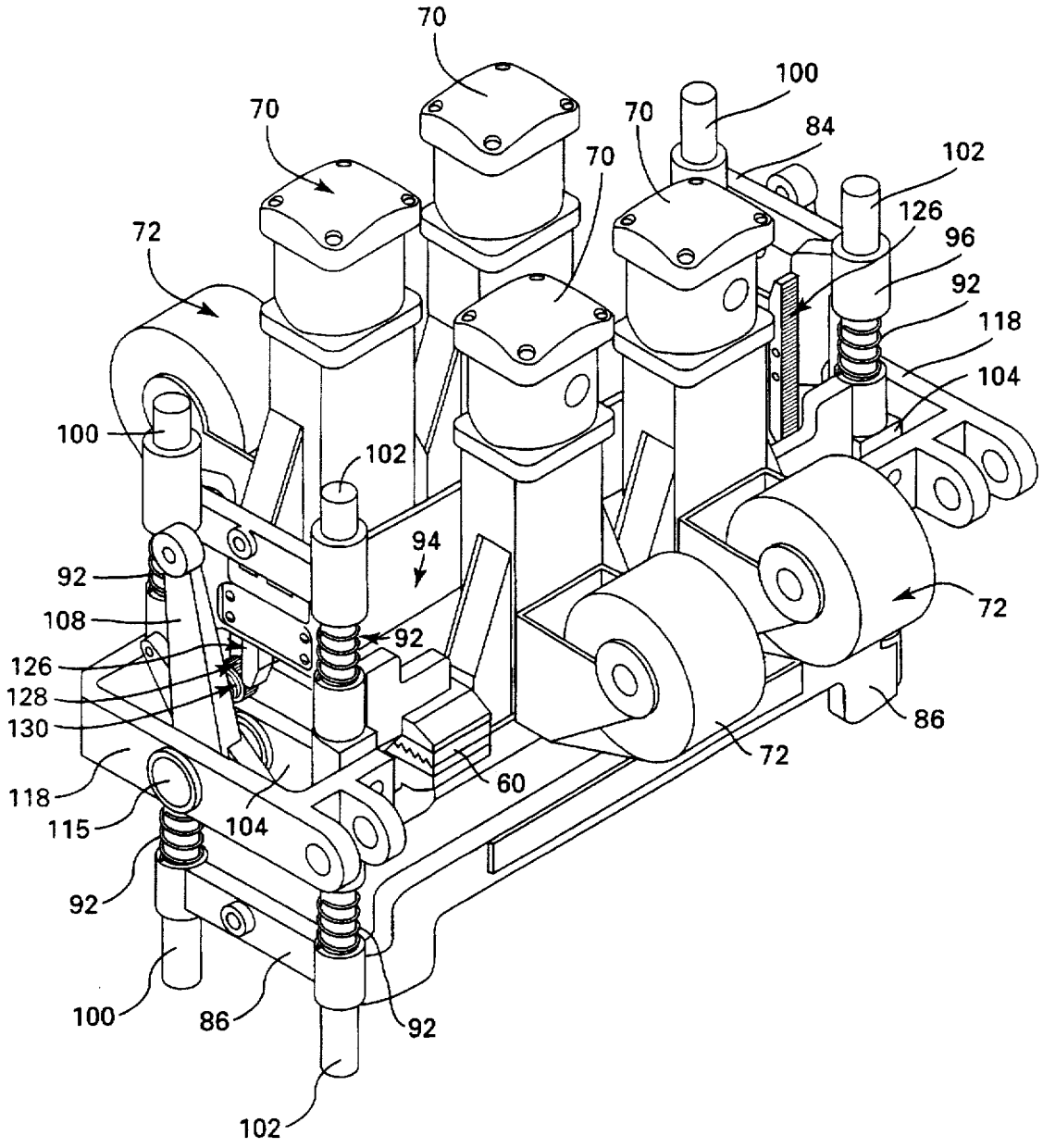
FIG. 8 is an assembled view of the clamping, cutting, and stitching mechanism of FIG. 7.

The components of the clamping, cutting, and stitching mechanism are more clearly illustrated in FIGS. 6, 7 and 8. Note that FIGS. 7 and 8 have the mechanism 31 rotated 90° from the operative position for illustrative purposes only. In FIG. 6, the mechanism 31 is mounted on guides 74 between a pair of slide rails 76. The movement of the clamping, cutting and stitching mechanism 31 is controlled by a hydraulic ram 78 and piston 80.

Turning to FIG. 7, the parts of the mechanism 31 are shown in an exploded view. The mechanism 31 is assembled from a driver frame 84 and an anvil frame 86. Attached to the driver frame 84 is a driver jaw frame 88; attached to the anvil frame 86 is an anvil jaw frame 90. Compression springs 92 are positioned at each of the four corners between the driver frame 84 and driver jaw frame 88 and between the anvil frame 86 and anvil jaw frame 90. There are two pairs of upper holding jaws 60; two mounted on the driver jaw frame 88 and two mounted on the anvil jaw frame 90. There are two pairs of lower holding jaws 64; two being mounted on the driver jaw frame 88 and two mounted on the anvil jaw frame 90. The lower holding jaws 64 on the anvil jaw frame 90 are aligned with and engage the lower holding jaws 64 on the driver jaw frame 88. In the same manner, the upper holding jaws 60 on each frame 88, 90 are aligned with each other.

The cutting blade 66 is attached to the anvil jaw frame 90. A driver cutting blade 94 is mounted to the driver frame 84. The blades 66 and 94 engage each other in a scissor like shearing manner during the cutting step.

At each corner of the driver frame 84, anvil frame 86, driver jaw frame 88 and anvil jaw frame 90 are tubular passageways. Upper tubular passageways 96 are adjacent to the upper holding jaws 60. Lower tubular passageways 98 are adjacent to the lower holding jaws 64.

The horizontal movement of the driver frame 84 and anvil frame 86 is guided by means of two pairs of parallel rods. There is a lower guide post 100 and an upper guide post 102. The lower tubular passageways 98 have the lower guide posts 100 slidably received within them. The upper tubular passageways 96 have the upper guide posts 102 slidably received within them.

Carrier arms 104 span the guide posts 100, 102. At each end of the carrier arms 104 are tubular passageways which slidably receive the guide posts 100, 102. On both sides of the mechanism 31 is the drive means to operate the cutting, folding jaw opening and jaw closing. It is comprised of the carrier arms 104, pitman arms 108, cross links 110, and drag links 112. There is a pivotal connection point 114 which attaches to the end of the piston 80. Pitman arm 108 and cross links 110 are mounted on a shaft 115 which has one end received in the central passageway 106. The other end of the shaft 115 is received in passageway 116 of dampening device cross support 118. A central passageway 106 passes through each of the carrier arms 104.

There are a set of top folding bars 120 and a set of bottom folding bars 122. After the tube is cut, these folding bars pivot 180° such that the cut tube forms a flap which is folded back over itself. The folding bars will hold the flap in this position until the flap is stitched closed by the stitching mechanism 70. There are openings 124 in the top and bottom folding bars through which the stitching mechanism passes. After the stitching mechanism 70 has completed its stitching function, the top and bottom folding bars 120 and 122 will pivot back to their original position.

Also mounted on the driver jaw frame 88 are four rack gears 126 which mesh with four folding bar pinion gears 128. The folding bar pinion gears 128 are attached to the folding bars 120, 122 by means of torsion springs 130.

Figure 9:
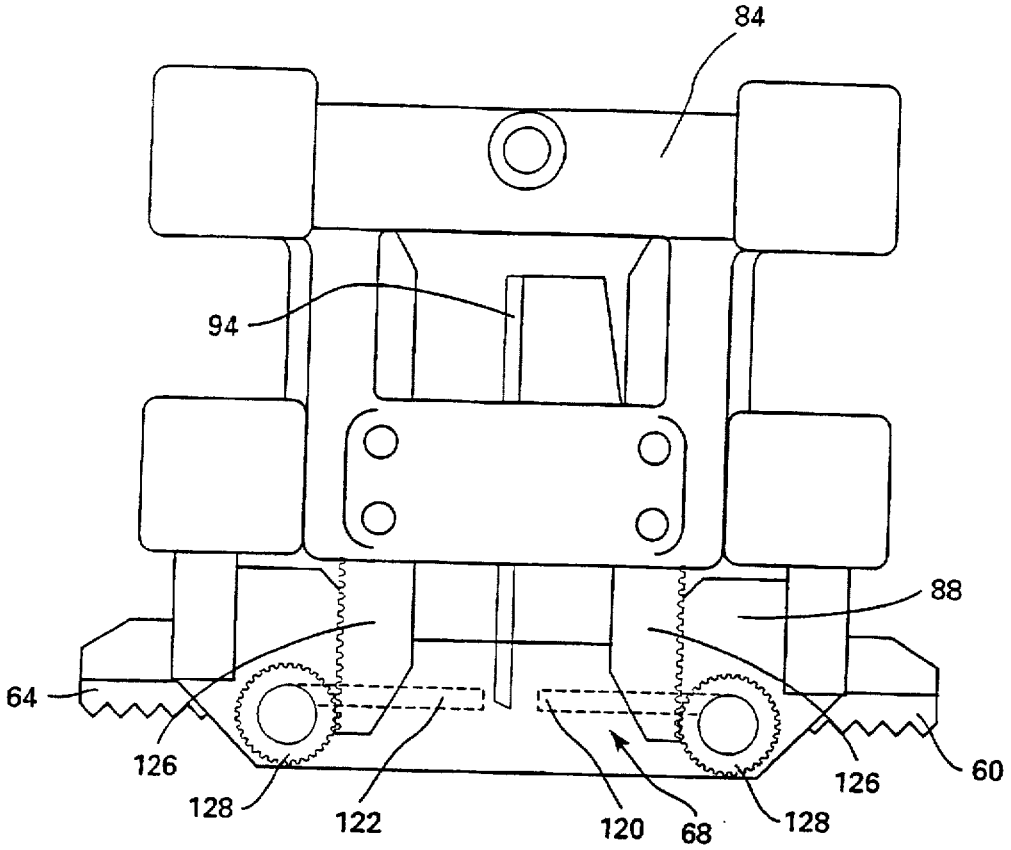
FIGS. 9 through 12 are enlarged views with portions removed of the bag clamping, cutting and stitching mechanism through a portion of a cycle, showing the progressive stages of the jaws in their open position, through the clamped cutting and stitching position.
Figure 9:
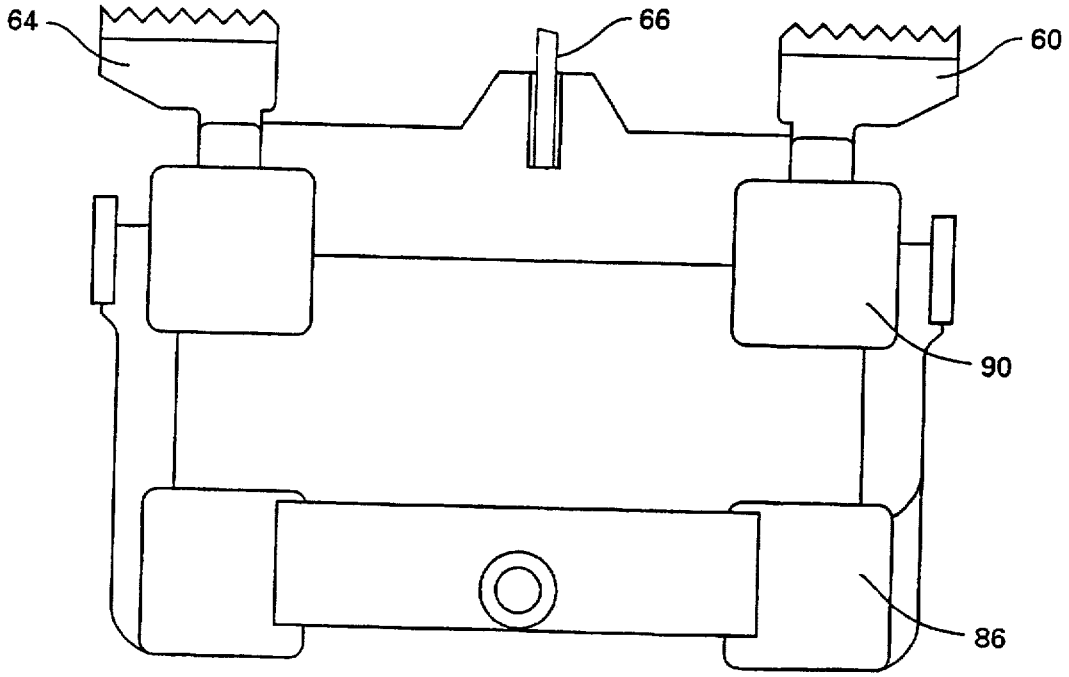

In order to fully understand the operation of the bag filling, cutting, and stitching mechanism, it is easiest to go through a complete cycle. The clamping, cutting, and stitching mechanism 31 is first pulled adjacent to the discharge end 40 of the twin screw conveyor 36. This is accomplished by the hydraulic ram 78 pulling the piston 80 upward. The top holding jaw 60 and bottom holding jaw 64 are separated to their fullest extent so that the formed bag 62 easily passes through the gap between the jaws, as illustrated in FIG. 9. The guides 74 and slide rails 76 help maintain the mechanism 31 in vertical alignment. A movement dampening device 132, which can be either a gas or a gas/oil dampened cylinder, is connected to the dampening device cross support 118 at attachment pivot point 134 as seen in FIG. 6.

Figure 10:
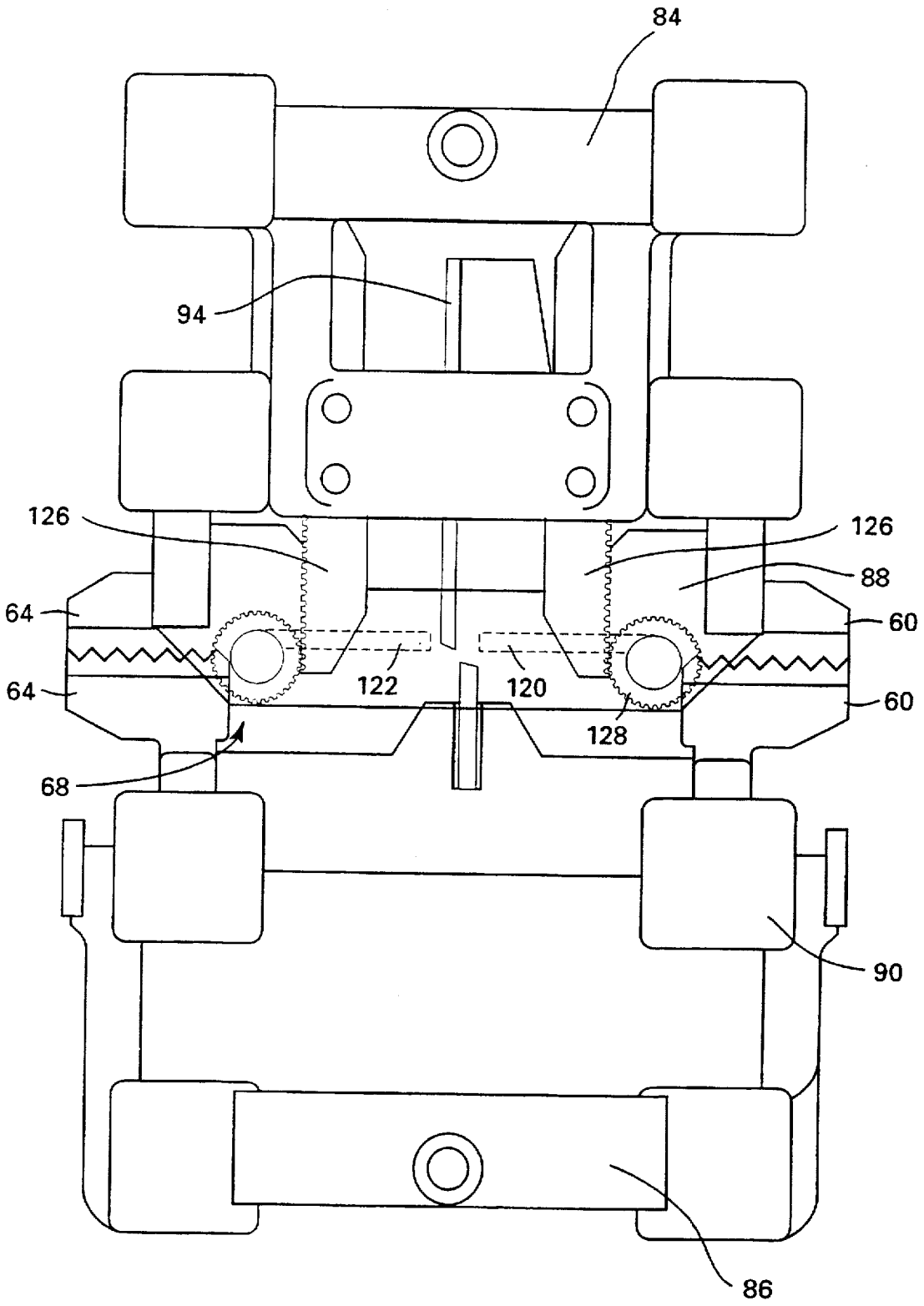

The hydraulic ram then pushes the piston 80 downward, which exerts a force on the pitman arms 108, which in turn exert a force on the carrier arms 104. This movement is resisted by the dampening device 132 attached to the carrier arms 104. The pitman arms 108 continue to rotate downward, while the carrier arms 104, due to the counter action of the dampening device 132, trails them. The rotation of the pitman arms 108 affects drag links 112 which pull the driver frame 84 and anvil frame 86 together, as seen in FIG. 10. Between the driver frame 84 and anvil frame 86 are the two upper holding jaws 60 and two lower holding jaws 64. The contraction of the driver frame 84 against the anvil frame 86 puts pressure on the mating pairs of jaws 60 and 64 by means of the compression springs 92. The jaws 60, 64 then move together, clamping the tube 58 securely at four points. The clamping pressure must be sufficient to close effectively the formed tube 58 so that the filling material will not leak past the jaws. The hydraulic cylinder 78 continues pushing the piston 80 downward away from the discharge end 40 of the screw conveyor 36. The twin screw conveyor 36 discharges the fill 24 into the tube 58 as the piston 80 continues its downward stroke.

The driver frame 84 continues its movement toward the anvil frame 86. This brings the driver cutting blade 94 into cutting engagement with the cutting blade 66. In this manner the tube 58 is cut while still being held securely, as seen in FIG. 11.

Figure 11:
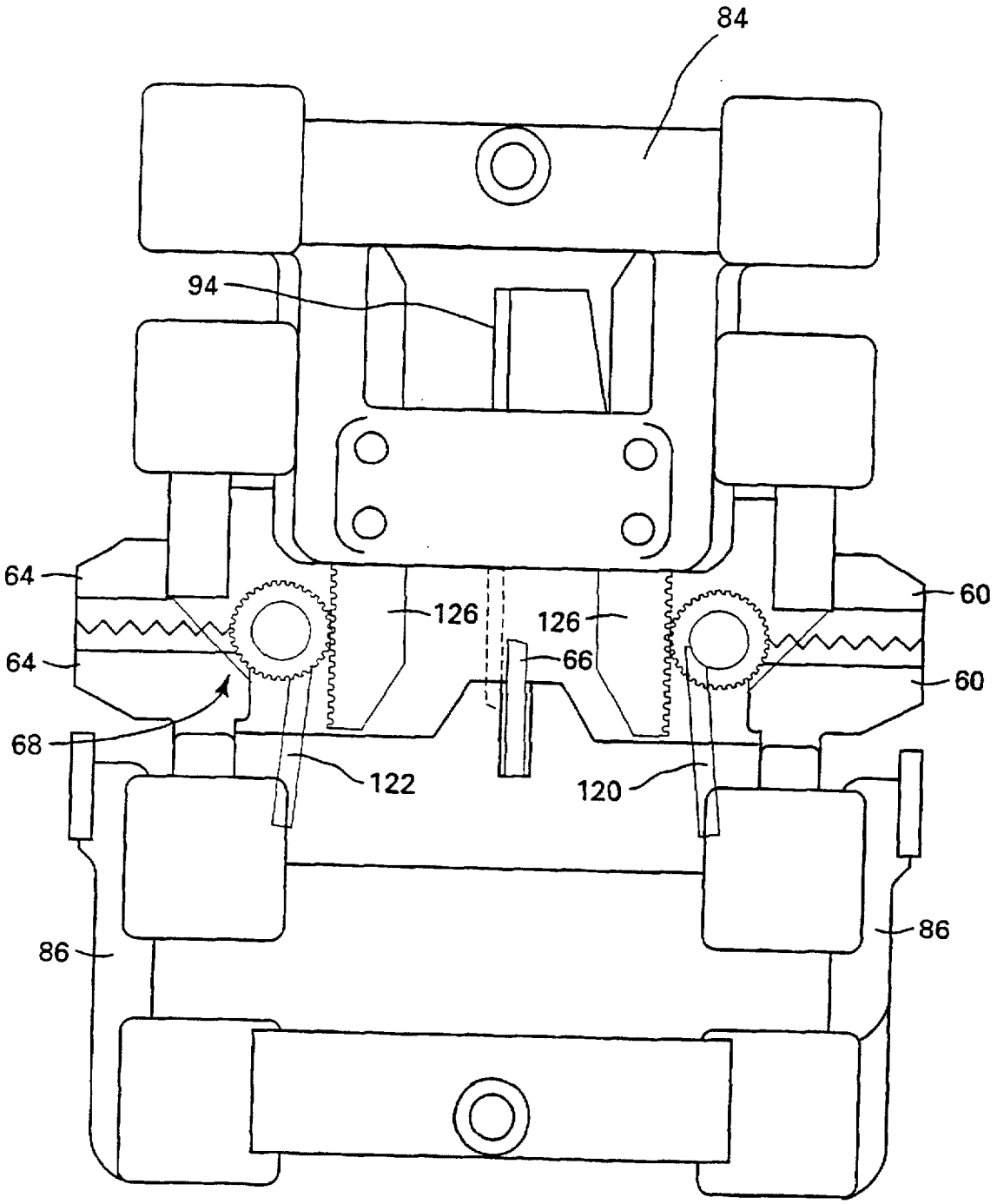

Also, as seen in FIG. 11, the four rack gears 126 continue their downward movement while the anvil frame 86 has stopped. The rack gears 126 drive the folding bar pinion gears 128 causing them to rotate. The folding bar pinion gears 128 are attached to the folding bars 120, 122 via torsion springs 130. The rotary motion of the gears 128 creates tension on the folding bars 120, 122, thereby prestressing it to allow for better shearing action. Once the tube 58 is cut, the resistance against the folding bars 120, 122 is alleviated, and the folding bars 120, 122 are allowed to rotate downward, away from the cutting blade 66. The cut tube 58 is folded over its cut end, and clamped to the underside of the stitcher 70. (See FIG. 12.) The anvil frame 86, connected to the drag link 108 which is opposite to the drag link 108 connected to the driver frame 84, is then brought into contact with the closed folding bars 120, 122. The frame 86 holds the folding bars 120, 122 in place for the stitching operation. A switch (not shown) is activated which initiates the stitchers. The guides 74 advance in the slide rails 76, bringing the mechanism 31 to the bottom of its stroke.

At this point, the downward movement of the piston 80 reverses, which is activated by a switch tied into its movements. Movement of the carrier arm 104 is again dampened by the movement dampening device 132, forcing the pitman arms 108 to rotate back around their shafts 115. This causes the driver frame 84 and anvil frame 86 to open, which releases pressure on the compression springs 92, and via the rack gears 126 and pinion gears 128, and allows the folding bars 120, 122 to return to their original position. The jaws 60, 64 open sufficiently to allow the newly filled bag 62 to pass between them. The entire mechanism 31 then moves up to its original position to start a new cycle. The hydraulic cylinder 78 has approximately a 27 inch stroke, which is the approximate length of a sandbag.

As the jaws are opened, the bag **62*a* is released and ready for use. It can be released into a discharge pile for manual removal or, preferably, be conveyed away on the conveyor 73**. The device will continue to operate as long as there is filling material available, and material to form the sandbags themselves. The system can easily be designed to shut down when either of these two essential materials are not present.

Figure 12:
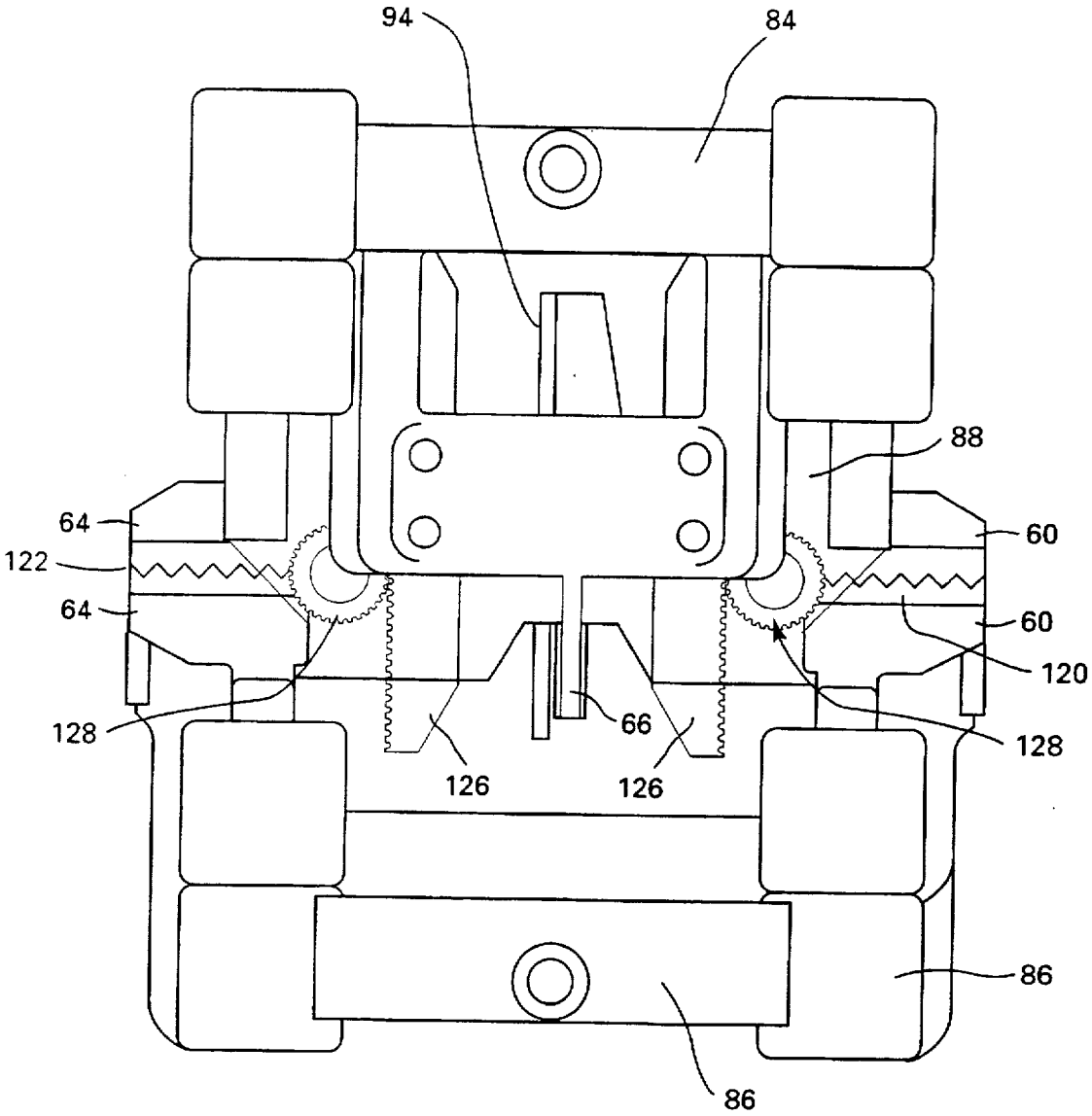
Figure 13:
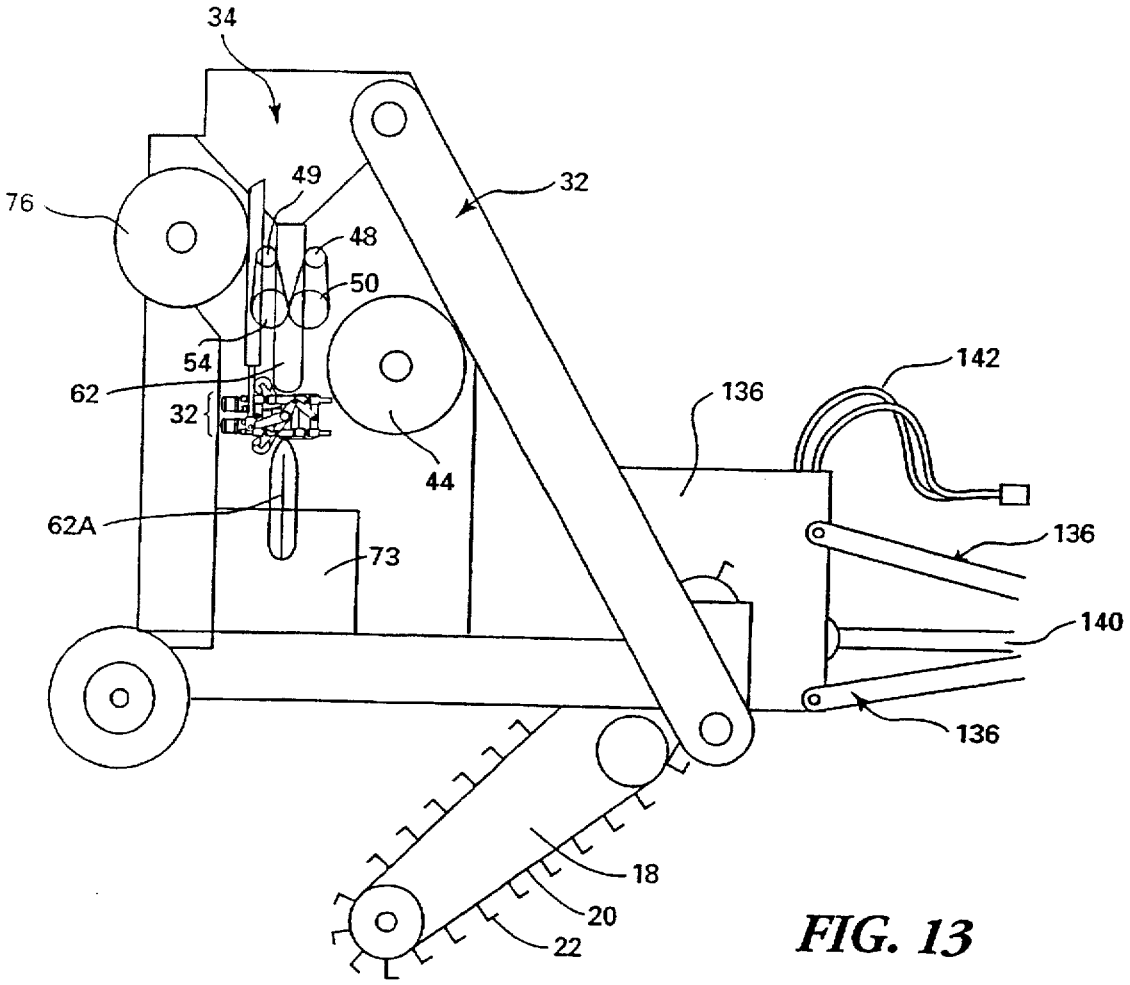
FIG. 13 is a right side elevation view of an alternate embodiment of a mobile sandbag forming and filling apparatus which is adapted for mounting on a trailer which is attached to a tractor or similar vehicle for transport.
Figure 14:
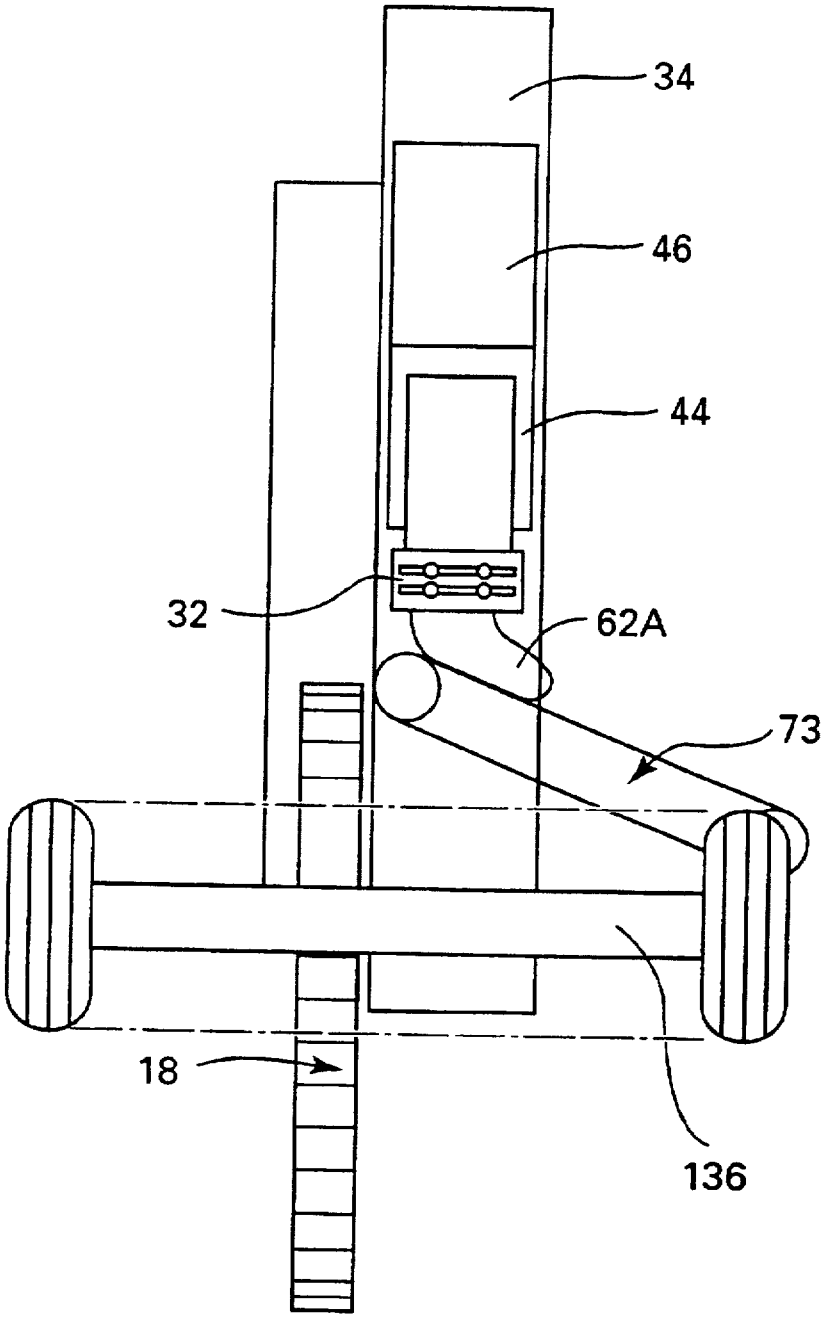
FIG. 14 is a rear elevation view of the apparatus of FIG. 13.

An alternate embodiment is illustrated in FIGS. 12 and 13. The entire apparatus is not mounted on a tracked vehicle. Rather, a lower cost version is to fully or partially mount the apparatus 10 on a standard agricultural tractor 136 by means of a three point hitch 138. The device could be powered by the power take-off unit 140, and remote hydraulic outlets 142.

Thus, while the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A sandbag filing apparatus for continuously making and filling sandbags comprising:

a frame assembly;

excavating means for excavating filling material mounted on the frame;

means for transporting the filling material to receiving means on the frame;

dispensing means for dispensing from the receiving means a predetermined amount of filling material upon demand;

control means for controlling the operation of the dispensing means;

means mounted on the frame for forming the sandbag with at least one end of the sandbag open;

means for placing the open end of the sandbag adjacent to the dispensing means to receive the predetermined amount of filling material; and closure means for automatically closing the open end of the sandbag;

whereby the filing material for filling the sandbags is excavated, automatically filled into the formed sandbags which are then removed for use.

2. The apparatus of claim 1 and further comprising bag removal means for removing the filled sandbag from the closure means.

3. The apparatus of claim 2 wherein the bag removal means is a conveyor belt.

4. The apparatus of claim 2 and further comprising transport means mounted to the frame for allowing the frame to be moved from one location to another.

5. The apparatus of claim 1 wherein the means for forming the sandbags comprises at least two continuous webs of material, means for drawing each of the webs towards each other so that an edge portion of each web contacts an edge portion of the other web, means for fastening the edge portions of each web to the other thereby forming closed sides for the sandbag.

6. The apparatus of claim 5 wherein the means for forming the sandbag comprises gripping means for securely holding and moving the web material, cutting means for cutting the individual sandbags from the web and folding means for folding the cut ends of the sandbags back over themselves.

7. The apparatus of claim 1 wherein the filling material dispensing means comprises a screw conveyor which dispenses the amount of filling material based upon the number of revolutions of the screw conveyor which is controlled by the control means.

8. The apparatus of claim 5 and further comprising adhesive application means for applying adhesive to edge portions of each of the webs which contact each other to cause the edges of the webs to seal thereby forming the sides of the bag.

9. The apparatus of claim 5 and further comprising stitching means for stitching edge portions of each of the webs which contact each other thereby forming the sides of the bags.

10. The apparatus of claim 1 wherein the closure means for closing the open end of the bag comprises a stitching mechanism that stitches the open end of the sandbag closed.

11. The apparatus of claim 6 and further comprising a movable operating head having mounted thereon the gripping means, the cutting means, the folding means and the closure means.

12. The apparatus of claim 11 and further comprising a slide mechanism on which the movable head is mounted which moves the web away from the dispensing means as the filling material is dispensed into the sandbag.

13. The apparatus of claim 1 wherein the closure means simultaneously closes an end of two successively formed and filled sandbags.

14. The apparatus of claim 1 wherein the means for forming the sandbags comprises a continuous web of material, and means for fastening one edge of the web to the other edge of the web for forming a hollow tube which receives the filling material.

15. A sandbag filling apparatus for continuously making and filling sandbags comprising:

a frame assembly;

excavating means for excavating filling material mounted on the frame;

means for transporting the filling material to receiving means on the frame;

dispensing means for dispensing from the receiving means a predetermined amount of filling material on demand;

control means for controlling the operation of the dispensing means;

means for forming a hollow tube with open ends from a web of bag forming material;

means for placing one open end of the tube adjacent to the dispensing means;

clamping means for closing the tube at a distal location from the open end;

closure means for automatically closing the tube at both the distal location and the open end after the predetermined amount of filling material has been deposited into the tube;

cutting means for cutting the sandbag from the web of bag forming material;

bag removal means for removing the filled sandbag from the closure means;

whereby the apparatus excavates the filling material, and automatically forms, fills, closes and removes the sandbag for use.

16. The apparatus of claim 15 wherein the bag removal means comprises a conveyor belt which moves the bags after being released by the clamping means.

17. The apparatus of claim 15 and further comprising transport means mounted to the frame for allowing the frame to be moved from one location to another.

18. The apparatus of claim 15 wherein the means for forming the sandbags comprises at least two continuous webs of material, means for drawing each of the webs towards each other so that an edge portion of each web contacts an edge portion of the other web, means for fastening the edge portions of each web to the other thereby forming closed sides for the sandbag.

19. The apparatus of claim 15 wherein the means for forming the sandbags comprises a continuous web of material, and means for fastening one edge of the web to the other edge of the web for forming a hollow tube which receives the filling material.

20. The apparatus of claim 19 wherein the means for forming the tube comprises gripping means for securely holding and moving the web material, cutting means for cutting the individual sandbags from the web and folding means for folding the cut ends of the sandbags back over themselves.

21. The apparatus of claim 15 wherein the filling material dispensing means comprises a screw conveyor which dispenses the amount of filling material based upon the number of revolutions of the screw conveyor which is controlled by the control means.

22. The apparatus of claim 18 and further comprising adhesive application means for applying adhesive to edge portions of each of the webs which contact each other to cause the edges of the webs to seal thereby forming the sides of the bag.

23. The apparatus of claim 18 and further comprising stitching means for stitching edge portions of each of the webs which contact each other thereby forming the sides of the bags.

24. The apparatus of claim 15 wherein the closure means for closing the open end of the bag comprises a stitching mechanism that stitches the open end of the sandbag closed.

25. The apparatus of claim 20 and further comprising a movable operating head having mounted thereon the gripping means, the cutting means, the folding means and the closure means.

26. The apparatus of claim 25 and further comprising a slide mechanism on which the movable head is mounted which moves the web away from the dispensing means as the filling material is dispensed into the sandbag.

27. The apparatus of claim 15 wherein the closure means simultaneously closes an end of two successively formed and filled sandbags.

28. The method of making and filling sandbags in one continuous operation comprising the steps of:

a. providing a frame with excavating means, means to transport excavated material to a receiving hopper, control means operatively connected to dispensing means for dispensing the excavated material, and sandbag forming means, all mounted on the frame;

b. excavating material with said excavating means to be used as fill in the sandbags;

c. transporting the excavated material to said receiving hopper;

d. transporting the excavated material from the receiving hopper to said dispensing means;

e. dispensing a predetermined amount of fill from said dispensing means upon demand;

f. controlling said dispensing means to dispense the correct predetermined amount of material at the correct time;

g. forming the sandbags with said sandbag forming means with at least one open end to receive the material;

h. placing the open end of the sandbag adjacent to the dispensing means and receiving the predetermined amount of material;

i. closing the open end of the sandbag;

j. removing the filled sandbag.

29. The method of claim 28 and further comprising the step of moving the excavating means thereby providing new material for fill as the bags are made and filled.

30. The method of claim 29 and further comprising the step of forming the bags from webs of material, cutting the bags from the webs, and forming the top, bottom and sides of the bags.

31. The method of claim 30 and further comprising the step of stitching the webs of material together along the sides.

32. The method of claim 30 and further comprising the step of gluing the webs of material together along the sides.

33. The method of claim 28 and further comprising the step of stitching the top and bottom of the bags to close the same.

34. The method of claim 30 wherein the sandbags are formed from a tube of web material, an open end of the tube being placed adjacent to the dispensing means, closing the tube at a distal location from the dispensing means for retaining the filling material within the tube, and dispensing the filling material into the tube.

35. The method of claim 2g and further comprising the step of providing a screw conveyor for dispensing the predetermined amount of fill based upon the number of revolutions of the screw conveyor which is controlled by the control means.

* * * * *

UNITED STATES PATENT AND TRADEMARK OFFICE

CERTIFICATE OF CORRECTION

PATENT NO. : 5,893,260

DATED : 04/13/99

INVENTOR(S) : Mark McKenna

It is certified that error appears in the above-identified patent and that said Letters Patent is hereby corrected as shown below:

Claim 35, Line 1, after the word "claim", please delete "2g" and substitute the number -- 28 --.

Signed and Sealed this

Twenty-eighth Day of September, 1999

*Attest:*

Q. TODD DICKINSON

*Attesting Officer*

*Acting Commissioner of Patents and Trademarks*